US005398847A

United States Patent [19]

Hasegawa

[11] Patent Number: 5,398,847

[45] Date of Patent: Mar. 21, 1995

[54] CYLINDER/PISTON TYPE FLUID CONTAINER

[75] Inventor: Takanori Hasegawa, Tokyo, Japan

[73] Assignee: Riso Kagaku Corporation, Tokyo, Japan

[21] Appl. No.: 62,514

[22] Filed: May 17, 1993

[30] Foreign Application Priority Data

| | | | |
|---|---|---|---|
| May 18, 1992 | [JP] | Japan | 4-124825 |
| May 18, 1992 | [JP] | Japan | 4-124826 |
| Jul. 29, 1992 | [JP] | Japan | 4-202586 |

[51] Int. Cl.[6] ..... B65D 1/00; B65D 83/00

[52] U.S. Cl. ..... 222/41; 222/23; 222/278; 222/386

[58] Field of Search ..... 222/23, 41, 256, 268, 222/386, 278

[56] References Cited

U.S. PATENT DOCUMENTS

| | | | |
|---|---|---|---|
| 2,070,206 | 2/1937 | Hudson . | |
| 2,118,373 | 5/1938 | Creveling | 222/256 |
| 2,928,610 | 3/1960 | Fenimore | 239/288.5 |
| 4,202,387 | 5/1980 | Upton | 222/23 |
| 4,664,298 | 5/1987 | Shew | 222/256 |
| 4,676,409 | 6/1987 | Stolz | 222/256 |

*Primary Examiner*—Karen B. Merritt
*Attorney, Agent, or Firm*—Dickstein, Shapiro & Morin

[57] ABSTRACT

In a fluid container comprising a container main body, a first piston member which defines a fluid containing chamber of a variable internal volume in cooperation with associated walls of the container main body, and a content expelling tube for conducting the content of the fluid container to a content outlet, a second piston member is placed inside the content expelling tube so that the second piston member may be moved inside the content expelling tube to take out the content from the content outlet when the first piston member has reached its stroke end and the content inside the fluid containing chamber has been all taken out. Thus, the content expelling tube may be conveniently employed for guiding the movement of the first piston member without reducing the inner capacity of the fluid container. If the movement of the second piston member is detected with an appropriate sensor, it is possible to detect the depletion and/or the imminence of the depletion of the content of the fluid container in a reliable manner because the movement of the second piston member is typically more pronounced than the first piston member which normally has a substantially larger diameter than the second piston member.

24 Claims, 12 Drawing Sheets

CYLINDER/PISTON TYPE FLUID CONTAINER

TECHNICAL FIELD

The present invention relates to a cylinder/piston type fluid container for accommodating fluid such as liquids, viscous substances, granules and powders, and in particular to a fluid container which is adapted to expel its content by using power means, for instance by using a suction pump or the like.

The present invention also relates to a cylinder/piston type fluid container provided with means for detecting the amount of fluid content remaining in the fluid container.

BACKGROUND OF THE INVENTION

As a fluid container for accommodating fluid such as liquids, viscous substances, granules and powders, there is conventionally known a piston/cylinder type fluid container comprising a tubular container main body having at least one end closed by an end wall, and a piston member internally received in the container main body in an axially slidable manner, thereby defining a fluid containing chamber having an annular cross section in cooperation with the end wall. Such fluid containers are disclosed, for instance, in Japanese patent laid open publication (Kokai) Nos. 59-37162 and 59-37163.

Such a fluid container is used, for instance, as an ink bottle for a printer such as a stencil printer, and its content or printing ink can be taken out of the container by suction via a content outlet provided in the tubular container main body connected to a suction pump.

In such a process of taking out the content by suction, the piston member axially moves inside the tubular container main body following the expulsion of the content out of the content outlet, but, as the inner diameter of the tubular container main body is increased to meet the demand for a larger capacity of the container, the piston member acquires the tendency to slant with respect to the axial line, thereby causing a sticking between the piston member and the cylinder wall. Once the piston member becomes stuck at a middle point in its axial movement inside the tubular container main body, the content inside the tubular container main body will be no longer available for use.

In view of such a problem of the prior art, the same applicant has proposed in Japanese utility model application No. 2-123755 a fluid container comprising an internal tubular member axially and securely fitted inside a container main body, and a piston member internally received in the container main body and externally fitted on the content expelling tube in an axially slidable manner, thereby defining a fluid containing chamber having an annular cross section in cooperation with an end wall so that a fluid containing chamber having an annular cross section may be defined inside the container main body and the end wall, and the axial movement of the piston member may be guided by the internal tubular member.

According to such a fluid container provided with an internal tubular member, a desired object can be achieved. Further, according to such a fluid container provided with an internal tubular member, it is possible to communicate the interior of the content expelling tube with the interior of the container main body at an end wall side of the container main body, and to provide a content outlet at an end of the content expelling tube.

However, in the case where the content expelling tube is given with the additional function as a member for defining the content outlet, after the piston member has reached its stroke end adjacent to the end wall of the container main body, the content remaining in the content expelling tube cannot be expelled, thereby wasting the part of the content finally remaining in the content expelling tube.

According to such a piston/cylinder type fluid container, the content can be taken out with less waste as compared to the more conventional fluid container such as a laminated tube, but, on the other hand, once the content of the fluid container is all taken out as designed, there is no way to take out the content therefrom any further no matter how attempts are made. On the other hand, in the case of a laminated tube, even after the content is depleted in normal sense, it is still possible to squeeze the laminated tube hard, and force out a small amount of content such as printing ink which may serve the purpose until a new laminated tube is made available.

Therefore, for instance, in the case of an ink bottle of a printer from which the content or printing ink is taken out by using power means, unless a new bottle is prepared before the content of the current ink bottle is depleted, a situation may arise in which printing becomes totally impossible without any warning.

To avoid such an inconvenience to occur, the operator must be always aware of the remaining amount of the content of the container, and this not only imposes a burden on the operator but is intrinsically unreliable.

In such a cylinder/piston type fluid container, as means for detecting the depletion or the imminence of the depletion of the fluid content, it has been proposed, for instance, in Japanese patent laid open publication (Kokai) No. 59-37163, to detect the position of the piston member by providing a sensing portion consisting for instance of a magnetic member in the piston member for detection by a non-contact type sensor for detecting the position of the piston member such as a reed switch placed at a stroke end of the piston member or a position adjacent thereto.

However, according to such a method for detecting the amount of fluid content remaining in a fluid container, it is necessary to detect the movement of the piston member in a non-contact manner and, to achieve a high precision in detection, it is necessary as a matter of course to precisely position the sensing means with respect to the fluid container. Further, when the sensing means is to be placed on one side of the fluid container for detecting the movement of the piston member, it is necessary for the piston member to move without inclining in the radial direction or without any rocking movement, and the sensing portion such as a magnetic member must be placed over the entire circumference of the piston member.

The internal cross section of the fluid container or the outer diameter of the piston member increases as the volume of the fluid content in the fluid container is increased, and the increase in the outer diameter of the piston member increases the tendency of the piston member to incline in the radial direction, and the increased length of the outer circumference of the piston member means the need for a larger amount of material for the sensing portion.

As the internal cross section of the fluid container increases, the speed of the movement of the piston member involved in taking out the content becomes lower. Such a slow movement of the piston member is advantageous when quantitatively and continually detecting the position of the piston member, but, when the arrival of the piston member at a certain position with an on-off sensing means is to be detected, as the speed of the movement of the piston member becomes lower, the accuracy of detection by the sensing means becomes increasingly more affected by the sensitivity of the sensing means, as well as the signal producing capability of the sensing portion, and becomes increasingly more prone to errors. For instance, when the arrival of a piston member at a prescribed position such as a stroke end of the piston member or a point adjacent thereto is to be detected by using a fixedly secured reed switch, the lower the speed of the movement of the piston member is, or, in other words, the more gradual the movement of the piston member is, the stronger the fluctuation in the position of the piston member at which the reed switch is activated, the position of the piston member at which the reed switch is activated being more strongly affected by the sensitivity of the sensing means and the signal producing capability of the sensing portion. This means the lack of reliability in the detection of the amount of the remaining content.

BRIEF SUMMARY OF THE INVENTION

In view of such problems of the prior art, a primary object of the present invention is to provide a fluid container which can effectively expel the content remaining in the content expelling tube even after the piston member has reached its stroke end adjacent the end wall of the container main body, and prevents any waste of the content by allowing all the content to be expelled in the end.

A second object of the present invention is to provide a fluid container which is provided with a centrally and axially extending tube serving as guide means for the first piston member and still does not cause any waste in the internal volume of the fluid container by the presence of the centrally and axially extending tube.

A third object of the present invention is to provide a fluid container which is provided with a centrally and axially extending tube serving both as guide means for the first piston member and as a content expelling tube for conducting the content to the content outlet, and still does not cause any waste in the content which would otherwise remain inside the content expelling tube after the fluid container is used up.

A fourth object of the present invention is to provide a fluid container which is provided with means for preventing the occurrence of a situation in which the content is suddenly depleted without any warning and the work such as printing work which requires the content of the fluid container is made impossible without any warning.

A fifth object of the present invention is to provide a fluid container which is provided with means for reliably and accurately indicating the depletion or the imminence of the depletion of the content.

According to the present invention, these and other objects can be accomplished by providing a fluid container, comprising: a container main body consisting of a hollow shell member; a first piston member internally received in the container main body in an axially slidable manner so as to define a fluid containing chamber of a variable internal volume in cooperation with associated walls of the container main body; a content expelling tube fixedly secured to the container main body, and defining a content outlet at one end thereof; communication means for normally communicating the fluid containing chamber with the content outlet via at least a part of the interior of the content expelling tube; a second piston member normally internally received in an initial position defined in a part of the content expelling tube remote from the content outlet in an axially slidable manner; and engagement means for selectively securing the second piston member at the initial position in such a manner that the second piston member may start moving inside the content expelling tube toward the content outlet after the first piston member has reached a stroke end corresponding to a minimum internal volume of the fluid containing chamber; rear ends of the first and second piston members having access to respective air vent holes for allowing the axial movements of the piston members as required.

According to this structure, after the first piston member has reached its stroke end adjacent to the end wall of the container main body, the second piston member provided in the content expelling tube starts moving toward the content outlet so that the movement of the second piston member may effect the expulsion of the content remaining in the content expelling tube from the content outlet. Thus, since the second piston member received in the content expelling tube forces the content out of the content expelling tube after the first piston member has reached its stroke end adjacent to an end wall of the container main body, none of the content filled in the fluid container is wasted with all the content conveniently expelled from the content expelling tube. Further, since the content expelling tube can be initially filled with the content, the content expelling tube would not in any way reduce the capacity of the fluid container.

In particular, the content expelling tube may extends centrally and axially inside the container main body so that the first piston member may be externally fitted on the content expelling tube whereby the content expelling tube serves as guide means for the axial movement of the first piston member. This structure ensures the smooth movement of the first piston member without any fear of sticking of the piston.

In this case, a free end of the content expelling tube defining the content outlet may project out from an end wall of the container main body while a base end of the content expelling tube is supported by an opposite wall of the container main body, the communication means comprising at least one opening provided in the base end of the content expelling tube.

So that the second piston member may be activated automatically upon depletion of the content inside the fluid containing chamber, the engagement means may consist of interlocking mechanical engagement means which can disengage the second piston member by a suction applied to the content outlet for taking out a content of the fluid containing chamber when the content inside the fluid containing chamber has been substantially all taken out and the first piston member has reached a corresponding stroke end thereof.

Alternatively, the engagement means may comprise an engagement piece which extends from the second piston member, and is passed through the communication opening in such a manner that the second piston member is normally engaged at the initial position by engagement between the engagement piece and the opening but is disengaged when the first piston member reaches an end of its stroke and disengages the engagement piece from the opening.

As yet another alternate embodiment, the container main body may be provided with stopper means for defining a stroke end of the first piston member, and an end wall consisting of bellows means which defines the minimum internal volume of the fluid containing chamber in cooperation with the first piston member after the first piston member is engaged by the stopper means, and the engagement means may be adapted to disengage the second piston member by pressure applied by a part of the end wall as the end wall undergoes a contracting movement due to a suction applied to the content outlet after the first piston member has reached the stroke end and has been engaged by the stopper means. It is also possible to design the engagement means so that the second piston member may be disengaged by closing the communication opening by a part of the end wall as the end wall undergoes a contracting movement due to a suction applied to the content outlet after the first piston member has reached the stroke end and has been engaged by the stopper means.

According to these embodiments, the second piston member starts moving only after the first piston member has reached its stroke end adjacent to the end wall or after all the fluid content in the fluid containing chamber of the container main body has been taken out.

According to yet another embodiment of the present invention, a free end of the content expelling tube defining the content outlet projects out from an end wall of the container main body while a base end of the content expelling tube is supported by an opposite wall of the container main body, the communication means consisting of at least one opening provided in a part of the content expelling tube located inside the container main body and adjacent to the free end of the content expelling tube.

The content expelling tube may also extend along an end wall of the container main body adjacent to the stroke end of the first piston member corresponding to the minimum internal volume of the fluid containing chamber. Typically, the communication means comprises a communication opening provided in a base end of the content expelling tube remote from the content outlet, the communication opening normally communicating the fluid containing chamber with an interior of the content expelling tube. In this case also, the engagement means typically consists of an engagement piece, but the engagement piece may constructed in many different ways. For instance, the engagement piece may comprise a hinge plate member moveably attached to a member defining the communication opening by hinge means having a hinge axis extending diametrically across the communication opening. Alternatively, the engagement piece may comprise a gate plate member slidably supported by a member defining the communication opening so as to move into and out of the content expelling tube.

The content expelling tube may also consist of a secondary container which may be opened up only when the content in the fluid containing chamber has been depleted. For instance, the communication means may comprise a communication opening which is provided in a part of the content expelling tube adjacent to the content outlet, and a separator plate normally separating at least a major part of the interior of the content expelling tube from the communication opening, the communication opening normally communicating the fluid containing chamber with an interior of the content expelling tube, and the separator plate being moved so as to establish a communication between the major part of the interior of the content expelling tube and the communication opening when the first piston member has reached the stroke end and pushed the separator plate. In this case, the content expelling tube may contain a substance which may be different from or incompatible with the content in the fluid containing chamber.

It is also possible that the content expelling tube extends along a side wall of the container main body substantially in parallel with a direction of movement of the first piston member.

According to yet another embodiment of the present invention, the fluid container further comprising tab means for normally closing the air vent hole for the second piston member, the tab means being adapted to be torn off so as to open up the air vent hole for the second piston member.

According to this structure, even after the first piston member has reached its stroke end adjacent the end wall of the container main body, and all the content has been taken out from the fluid containing chamber of the container main body, by releasing the second piston member by applying the external operation to the engagement means, the second piston member is allowed to move toward the content outlet so that the content contained in the content expelling tube can be taken out for use. Therefore, it is possible to continue the work by making use of the content which is newly made available by allowing the movement of the second piston member.

To achieve the same end, instead of such a tab member, the fluid container of the present invention may comprise lid means for normally closing the air vent hole for the second piston member, the lid means being adapted to be selectively removed so as to open up the air vent hole for the second piston member.

To avoid depletion of the content of the fluid container without any warning, the fluid container of the present invention may further comprise means for detecting movement of the second piston member. Because the outer diameter of the second piston member being substantially smaller than that of the first piston member, for a given rate of taking out the content from the content outlet, the speed of the movement of the second piston member in taking out the content from the content outlet is substantially greater than the corresponding speed of the first piston member. Thus, since the movement of the second piston member is more pronounced than that of the first piston member, it is possible to promptly detect that the second piston member has started moving away from its initial position ad that the state of the photoelectric switch is thereby reversed by the failure of the light from the photoelectric switch to reach the light reflecting sheet of the second piston member, without any delay from the moment the second piston member has started moving. Thus, the detection of the depletion of the content all but the part of the content remaining inside the content expelling tube can be accomplished reliably and promptly.

Such a detection process can be accomplished in a number of ways. For instance, the detecting means may comprise a photoelectric sensor provided with a light emitting element and a light sensing element, and a reflective member secured to a rear end of the second piston member for interaction with the photoelectric sensor via the air vent hole for the second piston member.

Alternatively or additionally, the detecting means may comprise a magnetic sensor disposed adjacent to the second piston member at the initial position, and a magnetic piece secured to the second piston member, whereby the magnetic sensor can detect movement of the second piston member from the initial position. If the magnetic sensor is disposed adjacent to the content outlet, the magnetic sensor can detect movement of the second piston member approaching a stroke end of the second piston member.

When the content expelling tube is provided outside the container main body, it is possible to make the content expelling tube out of at least semi-transparent material so that the amount of the content may be visible from outside.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
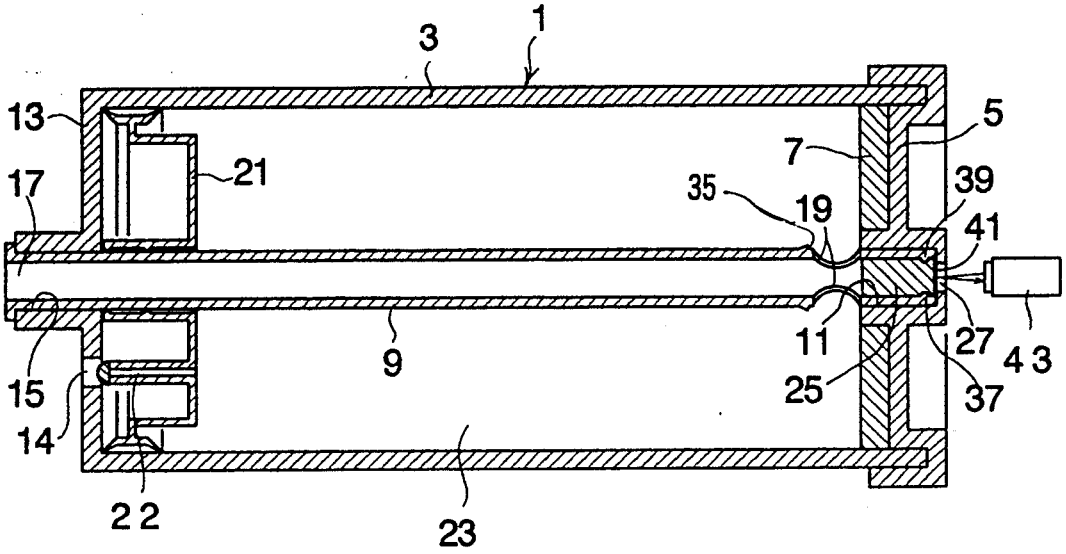
FIG. 1 is a sectional view of a first embodiment of the fluid container according to the present invention at its initial state.
Figure 2:
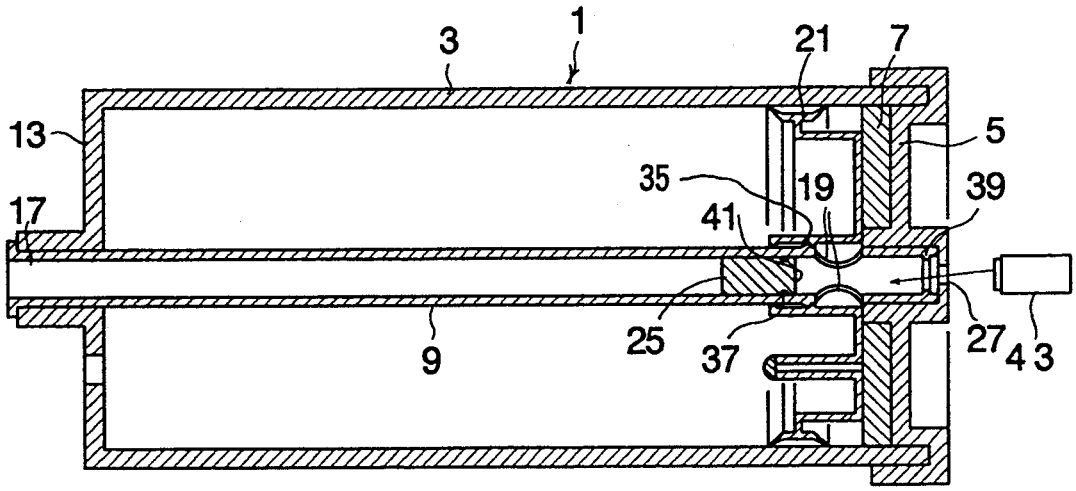
FIG. 2 is a sectional view of the first embodiment of the fluid container according to the present invention showing the manner of movement of the second piston member.

FIGS. 1 and 2 show a first embodiment of the fluid container according to the present invention. Numeral 1 denotes a container main body. The container main body 1 comprises a hollow cylindrical member 3 made of a suitable material, and an end cover 5 made of synthetic resin attached the right end of the cylindrical member 3 as seen in the drawings to close it from this end. Thus, this end cover 5 along with a spacer 7 placed on the inner face of the end cover 5 serves as an end wall closing an end of the container main body 1.

A content expelling tube 9 made of a suitable material is securely fixed in the central part of the container main body 1. The content expelling tube 9, at its one end shown on the right hand side of the drawings, is fitted into a recess 11 provided in the end cover 5 for receiving the tubular member, and, at its other end shown on the left hand side of the drawings, is passed through a central hole 15 provided in an end wall portion 13 integrally formed at the other end of the cylindrical member 3 so that the content expelling tube 9 may be secured by this end wall portion 13 and extends axially inside the container main body 1. The content expelling tube 9, at its other end shown on the left hand side of the drawings, extends through the central hole 15 of the end wall portion 13, and its free end defines a content outlet 17 opening out of the container.

The end of the content expelling tube 9 adjacent the end cover 5 on the right hand side of the drawings is provided with communication holes 19 for the communication between the interior of the content expelling tube 9 and the interior of the container main body 1.

The container main body 1 accommodates a first piston member 21 made of a synthetic resin material which is internally received in the container main body 1 in an air tight fashion, and is externally fitted on the content expelling tube 9 in an air tight fashion in axially slidable manner in each case, thereby defining a fluid containing chamber 23 having an annular cross section between the first piston member 21 and the spacer 7. The initial position of the first piston member 21 corresponds to its stroke end on the left hand side of the drawing, the first piston member 21 abutting the end wall portion 13, as illustrated in FIG. 1. The first piston member 21 defines the maximum volume of the fluid containing chamber 23 at this initial position.

The fluid containing chamber 23 communicates with the content outlet 17 via the communication holes 19 and the interior of the content expelling tube 9, and the content such as printing ink contained in the fluid containing chamber 23 can be taken out from the content outlet 17 via the communication holes 19 and the content expelling tube 9.

The end wall portion 13 of the cylindrical member 3 is provided with a back air vent hole 14 to ensure the rightward movement of the first piston member 21, and the first piston member 21 is provided with an air vent hole 22 for use when filling the fluid containing chamber 23 with the content. This air vent hole 22 is closed for instance by thermal crimping after the content has been filled into the fluid containing chamber 23.

The content expelling tube 9 accommodates therein a second piston member 25 which is internally received in the content expelling tube 9 in an air tight and axially slidable manner. The second piston member 25 made of a suitable material has its initial position at a right extreme position inside the content expelling tube 9 as illustrated in FIG. 1, and allows the communication to be maintained between the interior of the fluid containing chamber 23 and the interior of the content expelling tube 9, or, in other words, the content outlet 17 via the communication holes 19.

In the illustrated embodiment, to prevent the reverse movement (the movement from right to left in FIGS. 1 and 2) of the first piston member 21, a claw-shaped projection 35 is provided around the outer circumference of the content expelling tube 9.

The end cover 5 defines an end wall of the content expelling tube 9 at a right end thereof as seen in the drawings with the recess 11 thereof supporting the content expelling tube 9, and this end wall is provided with an air vent hole 27 for the rear end surface of the second piston member 25.

In the region where the second piston member 25 is fitted in the content expelling tube 9 at its initial position, there are provided interlocking engagement portions 37 and 39 which retain the second piston member 25 with a prescribed resistance force against disengagement. The interlocking engagement portions 37 and 39 engage the second piston member 25 with a prescribed resistance against displacement from its initial position when the second piston member 25 is at its initial position, and this resistance force is determined to be greater than the force acting on the second piston member 25 when the content is being expelled with the first piston member 21 being allowed to move inside the container main body 1, and to correspond to the force of suction that will be applied to the second piston member 25 when the suction is continued to be applied to the content outlet 17 after the first piston member 21 has reached its stroke end on the right hand side of the drawings and come into contact with the spacer 7.

On the reverse face of the second piston member 25 is attached a light reflecting sheet 41 made of aluminum foil or the like serving as a sensing portion.

To the right of the end cover 5 of the container main body 1 is placed a reflective type photoelectric switch 43 including a light emitting unit and a light receiving unit, and serving as detecting means. The photoelectric switch 43 is positioned in such a manner that light is projected upon the air vent hole 27 of the end cover 5, and receives the light reflected by the light reflecting sheet 41 of the second piston member 25.

According to the fluid container having the above described structure, first of all, when filling the container with the content, the first piston member 21 is placed at its initial position adjacent the end wall portion 14 of the cylindrical member 3 as illustrated in FIG. 1 with its air vent 22 opened up, and the content is filled into the fluid containing chamber 23 and the content expelling tube 9 from the content outlet 17 via the interior of the content expelling tube 9 and the communication holes 19 with the aid of pressure. When this pressure filling process is completed, the air vent 22 is closed for instance by thermal crimping. This process can be carried out by using the back air vent hole 14 of the end wall portion 13 of the cylindrical member 3 as an access hole.

The content filled into the container can be taken out by connecting the content outlet 17 with a suction hole of a suction pump not shown in the drawings. When the content outlet 17 is first connected to the suction hole of a suction pump, and a suction (negative pressure) is applied to the content outlet 17, the content filled into the interior of the content expelling tube 9 and the content containing chamber 23 is sucked out of the content outlet 17 via the communication holes 19 and the interior of the content expelling tube 9. Following the expulsion of the content from the interior of the content expelling tube 9 and the fluid containing chamber 23, the first piston member 21 is passively forced to move to the right as seen in the drawing in the axial direction inside the container main body 1.

Since a suction force greater than the prescribed level would not be applied to the second piston member 25 due to the axial movement of the first piston member 21 until the first piston member 21 reaches its stroke end on the right hand side of the drawings and comes into contact with the spacer 7, the engagement by the interlocking engagement portions 37 and 39 is maintained, and the second piston member 25 is kept stationary at its initial position with the second piston member 25 thus engaged at its initial position.

Thus, the content of the fluid containing chamber 23 is allowed to be taken out from the fluid containing chamber 23 by the axial movement of the first piston member 21 without being obstructed by the second piston member 25.

Since the second piston member 25 is located at its initial position while the content is being taken out from the fluid containing chamber 23, the light projected from the photoelectric switch 43 to the air vent hole 27 of the end cover 5 reaches the reflective sheet 41, and is thereby reflected back to the photoelectric switch 43.

Therefore, the light projected by the photoelectric switch 43 upon the air vent hole 27 is, returned to the photoelectric switch 43 by being reflected by the light reflecting sheet 41 of the second piston member 25, and the photoelectric switch 43 produces, for instance, an ON-signal. This ON-signal may also be employed to indicate that the fluid container is placed at its proper position.

When the first piston member 21 has reached its stroke end on the right hand side of the drawing, and come into contact with the spacer 7 as illustrated in FIG. 2, the content of the fluid containing chamber 23 is completely depleted. When the first piston member 21 has reached its stroke end and abuts the spacer 7, thus becoming incapable of moving any further, and the suction is still continued to be applied to the content outlet 17, the second piston member 25 is then subjected to a suction pressure which exceeds the prescribed level.

As a result, the suction acting upon the second piston member 25 overcomes the resistance which the interlocking engagement portions 37 and 39 can produce for retaining the second piston member 25, and, upon disengagement of the interlocking engagement portions 37 and 39, the second piston member 25 starts moving from its initial position to the left hand side as seen in the drawings or towards the content outlet 17. This movement of the second piston member 25 allows the content of the content expelling tube 9 to be expelled from the content outlet 17.

When the second piston member 25 has started moving away from its initial position, the light projected by the photoelectric switch 43 toward the air vent hole 27 of the end cover 5 will not reach the light reflecting sheet 41 of the second piston member 25 because the second piston member 25 is no longer at its initial position. As a result, the photoelectric switch 43 would not receive any reflected light, and reverses its state or, for instance, produces an OFF-signal.

Thus, once the second piston member has started moving and left its initial position, or, in other words, once the content of the fluid container is all taken out, the output signal of the photoelectric switch 43 changes, and it indicates that all the content in the fluid container except for the part of the content remaining in the content expelling tube has been taken out, and the fluid container is required to be changed soon.

Since the inner cross sectional area of the content expelling tube 9 is substantially smaller than that of the container mainbody 1 of the fluid containing chamber 23, for a given rate of taking out the content from the content outlet 17, the speed of the movement of the second piston member 25 in taking out the content from the content outlet 17 is substantially greater than the corresponding speed of the first piston member 21. Thus, since the movement of the second piston member 25 is more pronounced than that of the first piston member 21, it is possible to promptly detect that the second piston member 25 has started moving away from its initial position and that the state of the photoelectric switch 43 is reversed by the failure of the light from the photoelectric switch 43 to reach the light reflecting sheet 41 of the second piston member 25, without any delay from the moment the second piston member 25 has started moving. Thus, the detection of the depletion of all the content but the part remaining inside the content expelling tube 9 can be accomplished reliably and promptly.

Figure 3:
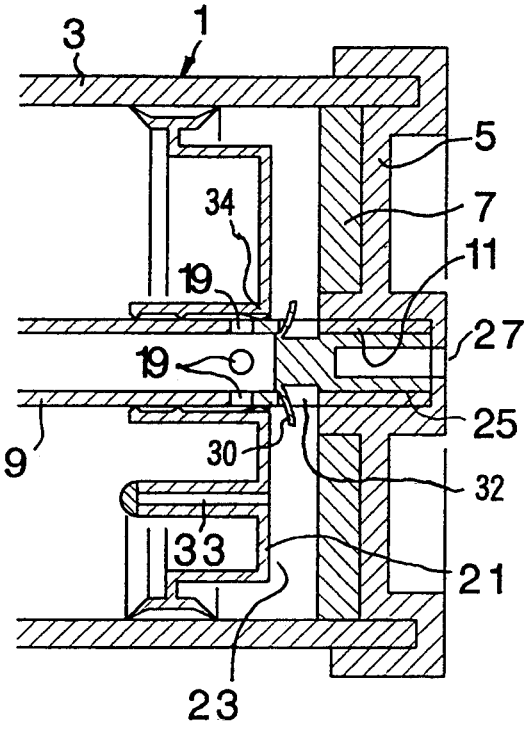
FIG. 3 is a sectional view of an essential part of a second embodiment of the fluid container according to the present invention at its initial state.
Figure 4:
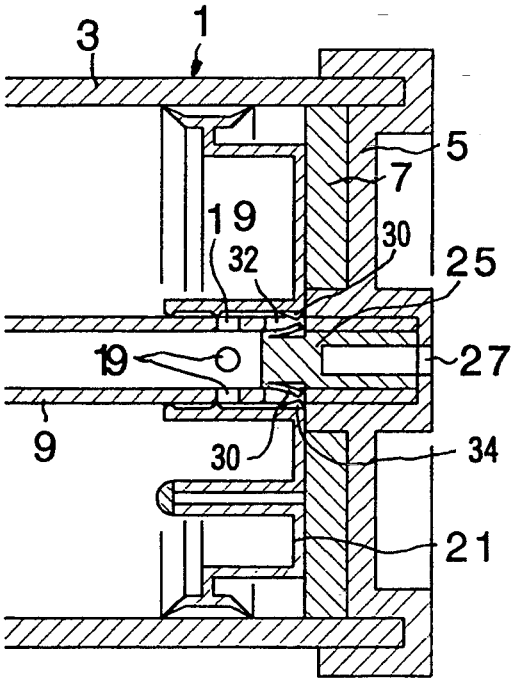
FIG. 4 is a sectional view of an essential part of the second embodiment of the fluid container according to the present invention when the first piston member has reached its stroke end.

FIGS. 3 and 4 show essential parts of a second embodiment of the fluid container according to the present invention. In FIGS. 3 and 4, the parts corresponding to those of FIGS. 1 and 2 are denoted with like numerals. In this embodiment, engagement pieces 30 are provided in the second piston member 25, and these engagement pieces 30 are engaged with engagement openings 32 provided in the inner tubular body 9 when the second piston member 25 is at its initial position, with the engagement pieces 30 being in their outwardly extended position as illustrated in FIG. 3, so as to engage the second piston member 25 at its initial position.

In the above mentioned initial condition, the engagement pieces 30 are passed through the engagement openings 32, and extend out of the outer circumferential surface of the content expelling tube 9. However, by the movement of the first piston member 21 to its stroke end, the engagement pieces 30 are radially inwardly urged so as to either elastically or plastically be deformed by pressure from a pressure projection 34 provided entirely or partly around the inner circumferential surface of the first piston member as illustrated in FIG. 4. As a result, the force of engagement with the engagement opening 32 is either reduced or completely eliminated.

Therefore, according to this embodiment also, until the first piston member 21 reaches its stroke end and abuts the spacer 7, with the engagement pieces 30 being engaged with the engagement openings 32, the second piston member 25 is kept stationary at its initial position. Thereby, the second piston member 25 allows the content to be expelled from the fluid containing chamber 23 without in any way obstructing the expulsion of the content from the fluid containing chamber 23.

Once the first piston member 21 reaches its stroke on the right hand side of the drawings and abuts the spacer 7, the pressure projection 34 of the first piston member 21 engages the engagement pieces 30 and presses them radially inwardly into either elastic or plastic deformation as illustrated in FIG. 4. When the suction force is applied to the second piston member 25 in this condition, the second piston member 25 is moved inside the content expelling tube from its initial position to the left or toward the content outlet 17, and this movement causes the content of the content expelling tube 9 to be expelled from the content outlet 17.

Figure 5:
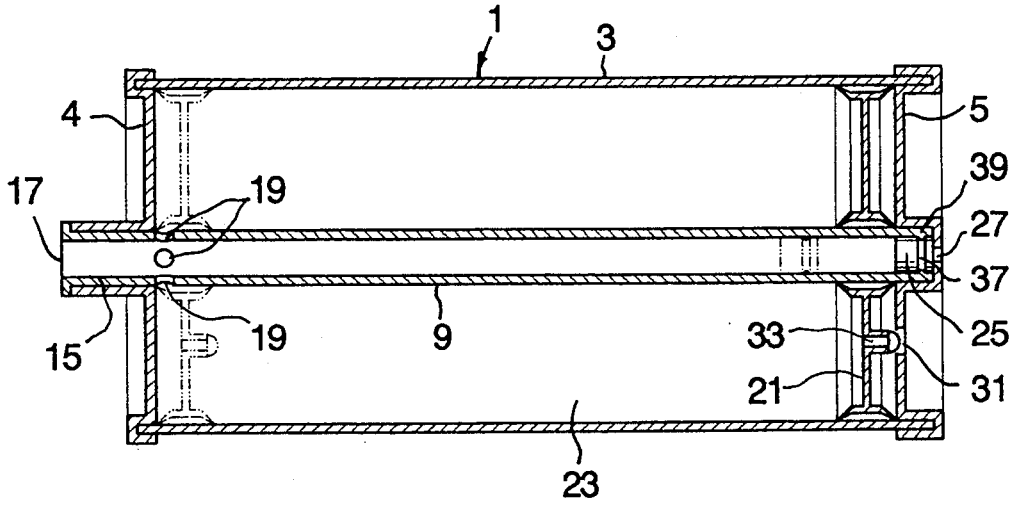
FIG. 5 is a sectional view of a third embodiment of the fluid container according to the present invention at its initial state with the first piston member at its stroke end indicated in imaginary lines.

FIG. 5 shows a third embodiment of the present invention. In FIG. 5 also, the parts corresponding to those of FIGS. 1 and 2 are denoted with like numerals. In this embodiment, the container main body 1 consists of a hollow cylindrical member 3 having two open ends, and a pair of end covers 4 and 5 which close the two open ends of the cylindrical member 3, and one of the end covers 4 on the left hand side as seen the drawing is provided with communication holes 19 which communicate the interior of the container main body 1 with the interior of the content expelling tube 9.

In this case, as indicated by the solid lines in FIG. 5, the initial position of the first piston member 21 is defined as a stroke end position at which the first piston member 21 abuts the end cover 5 on the right hand side as seen in the drawing, and the end wall closing the other end of the container main body 1 is formed by the other end cover 4.

In this embodiment also, the initial position of the second piston member 25 is defined at the right end of the content expelling tube 9 as seen in the drawing, and in the region where the second piston member 25 is fitted in the content expelling tube 9 at its initial position, there are provided interlocking engagement portions 37 and 39 which retain the second piston member 25 with a prescribed resistance force against disengagement.

When the content outlet 17 is first connected to the suction hole of a suction pump, and a suction is applied to the content outlet 17, the content filled into the interior of the fluid containing chamber 23 is sucked out of the content outlet 17 via the communication holes 19 and the interior of the content expelling tube 9. As the content is expelled from the interior of the fluid containing chamber 23, the first piston member 21 is passively forced to move to the left as seen in the drawing in the axial direction inside the container main body 1. In this case also, since a suction force greater than the prescribed level would not be applied to the second piston member 25 due to the axial movement of the first piston member 21 until the first piston member 21 reaches its stroke end on the left hand side of the drawings and comes into contact with the end cover 4, the engagement by the interlocking engagement portions 37 and 39 is maintained, and the second piston member 25 is kept stationary at its initial position with the second piston member 25 thus engaged at its initial position.

When the first piston member 21 has reached its stroke end on the left hand side of the drawing, and come into contact with the end cover 4, the content of the fluid containing chamber 23 is completely depleted. When the first piston member 21 has reached its stroke end and abuts the end cover 4, thus becoming incapable of moving any further, and the suction is still continued to be applied to the content outlet 17, the second piston member 25 is then subjected to a suction pressure which exceeds the prescribed level. As a result, the suction acting upon the second piston member 25 overcomes the resistance which the interlocking engagement portions 37 and 39 can produce for retaining the second piston member 25, and, upon disengagement of the interlocking engagement portions 37 and 39, the second piston member 25 starts moving from its initial position to the left hand side as seen in the drawings or towards the content outlet 17. This movement of the second piston member 25 allows the content of the content expelling tube 9 to be expelled from the content outlet 17.

Figure 6:
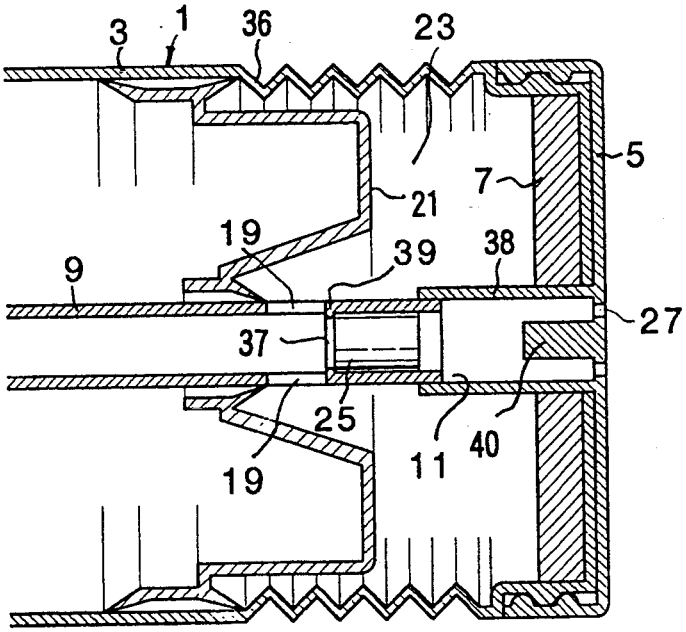
FIG. 6 is a view similar to FIG. 3 showing an essential part of a fourth embodiment of the present invention.

FIG. 6 shows a fourth embodiment of the fluid container according to the present invention. In FIG. 6, the parts corresponding to those of FIGS. 1 and 2 are denoted with like numerals. In this embodiment, the end of the cylindrical member 3 is formed as a bellows portion 36, and the end cover 5 is connected to the cylindrical member 3 via this bellows portion 36.

The end cover 5 is provided with a central tubular portion 38 serving as a recess 11 for slidably receiving and supporting the corresponding end of the content expelling tube 9, and the base end of this central tubular portion 38 or the bottom end of the recess 11 is integrally formed with a plunger 40 for driving the second piston member 25.

In this embodiment, as illustrated in FIG. 6, when the first piston member 21 reaches the bellows portion 36, the first piston member 21 is engaged by the bellows portion 36, and becomes unable to move any further inside the cylindrical member 3. When the content is continued to be expelled from the content outlet 17 (refer to FIG. 1), the bellows portion 36 is caused to be contracted, and this contracting movement of the bellows portion 36 causes the end cover 5 to move to the left as seen in the drawings. This movement of the end cover 5 causes the content of the fluid containing chamber 23 to be taken out.

When the end cover 5 has moved all the way to the left as seen in the drawing until the spacer 7 comes into contact with the first piston member 21, the fluid containing chamber 23 is substantially totally eliminated, and the content of the fluid containing chamber 23 has been all taken out.

This leftward movement of the end cover 5 causes the plunger 40 to abut the rear end of the second piston member 25, and the second piston member 25 is thus pushed leftward as seen in the drawing until the second piston member 25 is disengaged from the interlocking engagement portions 37 and 39 with the result that the second piston member 25 is eventually allowed to move inside the content expelling tube 9 toward the content outlet 17 as the content is sucked out of the content outlet 17. Thus, the movement of the second piston member 25 allows the content inside the content expelling tube 9 to be all taken out from the content outlet 17.

Figure 7:
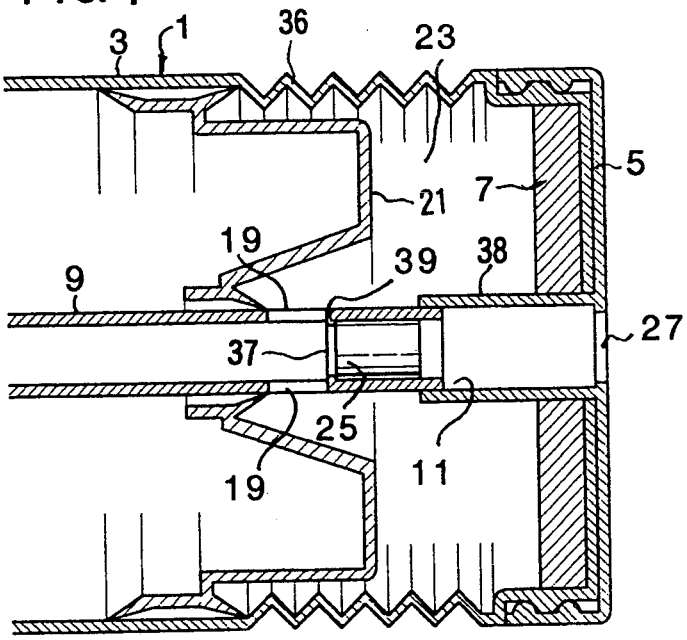
FIG. 7 is a view similar to FIG. 3 showing an essential part of a fifth embodiment of the present invention.

FIG. 7 shows a fifth embodiment of the fluid container according to the present invention. In FIG. 7, the parts corresponding to those of FIG. 6 are denoted with like numerals. In this embodiment, the leftward movement of the end cover 5 as seen in the drawing causes the central tubular portion 38 to close the communication holes 19.

In this embodiment, when the bellows portion 36 has been completely contracted, and the spacer 7 becomes unable to move any further by abutting the first piston member 21, since the communication holes 19 are closed by the central tubular portion 38, the second piston member 25 is subjected to a suction pressure greater than a prescribed level.

This suction pressure causes the second piston member 25 to overcome the engagement by the interlocking engagement portions 37 and 39, and the second piston member 25 is allowed to move toward the content outlet 17 as the content is sucked out of the content outlet 17. Thus, the movement of the second piston member 25 allows the content inside the content expelling tube 9 to be all taken out from the content outlet 17.

Further, with the communication holes 19 closed by the central tubular portion 38, it is possible to avoid that the content remaining inside the fluid containing chamber 23 after the second piston member has started moving be leaked out from the air vent hole 27 via the communication holes 19 and the recess 11 for supporting the content expelling tube 9.

In FIGS. 6 and 7, the end cover 5 is caused to move axially toward the content outlet 17, it is possible to detect the depletion of the content of the fluid containing chamber 23 and the imminence of the total depletion of the fluid container by the axial displacement of this end cover 5.

Thus, since the second piston member received in the content expelling tube forces the content out of the content expelling tube after the first piston member has reached its stroke end adjacent an end wall of the container main body, none of the content filled in the fluid container is wasted with all the contents conveniently expelled from the content expelling tube. Further, since the content expelling tube can be initially filled with the content, the content expelling tube would not in any way reduce the capacity of the fluid container.

FIGS. 8 through 11 show a sixth embodiment of the fluid container according to the present invention. In FIGS. 8 through 11, the parts corresponding to those of FIGS. 1 and 2 are denoted with like numerals. In this embodiment, the container main body 1 comprises a hollow cylindrical member 45 made of cardboard or the like which is processed for resistance against water and oil, and end covers 47 and 49 made of synthetic resin attached to the corresponding ends of the cylindrical member 45 to close them. The container main body 1 accommodates a first piston member 21 made of a synthetic resin material which is internally received in the container main body 1 in an air tight fashion. The initial position of the first piston member 21 corresponds to its stroke end on the right hand side of the drawings, the first piston member 21 abutting the end cover 49, and the first piston member 21 defines the maximum volume of the fluid containing chamber 23 at this initial position.

The end cover 49 is provided with a back air vent hole 51 for ensuring the leftward movement of the first piston member 21 as seen in the drawings.

Figure 8:
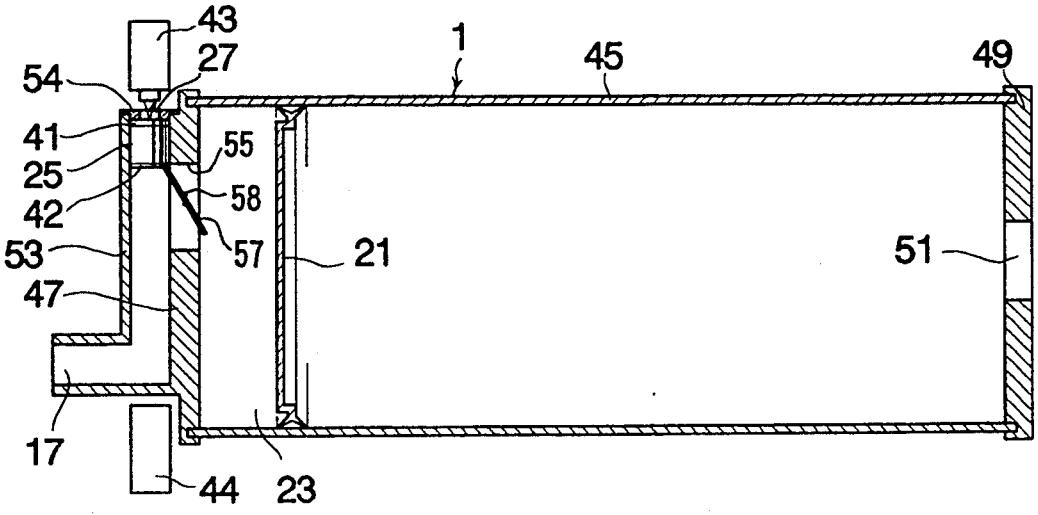
FIG. 8 is a sectional view showing an initial condition of a sixth embodiment of the fluid container according to the present invention.

The external face of the end cover 47 is integrally formed with a content expelling tube 53. The content expelling tube 53 defines a smaller inner cross section than the cross section of the fluid containing chamber 23, and extends radially with respect to the end cover 47, defining a content outlet 17 at its one end or its lower end as seen in FIG. 8. The content expelling tube 53 communicates with the inner space of the container main body 1 or the fluid containing chamber 23 via a communication hole 55 at an end opposite to that adjacent to the content outlet 17 or at its upper end as seen in FIG. 8.

Thereby, the fluid containing chamber 23 is communicated with the content outlet 17 via the communication hole 55 and the interior of the content expelling tube 53, and the content filled in the fluid containing chamber 23 such as printing ink can be taken out from the content outlet 17 via the communication hole 55 and the content expelling tube 53.

Since the content expelling tube 53 is integrally formed with the end cover 47, it serves also as a rib for reinforcement.

The content expelling tube 53 accommodates therein a second piston member 25 in axially slidable and air tight manner. As illustrated in FIG. 8, the initial position of the second piston member 25 is at an upper end of the content expelling tube 53 as seen in FIG. 8, or an end adjacent to the communication hole 55, and, when the second piston member 25 is at this initial position, the communication between the fluid containing chamber 23 and the interior of the content expelling tube or, in other words, the content outlet 17 is maintained by the communication hole 55 without being obstructed.

So that it may be visually detected that all the content has been taken out from the fluid container, the fluid expelling tube 53 is made of transparent material which allows the second piston member 25 inside the content expelling tube 53 to be seen from outside.

An end cap 54 having an air vent hole 27 for the rear end of the second piston member 25 is provided at an end of the content expelling tube 53 opposite to the content outlet 17.

A stopper 57 is integrally formed in the end cover 47 so as to be placed inside the communication hole 55. The stopper 57 is movably supported by the end cover 47 by way of a plastic hinge 58 having a hinge center line extending diametrically across the communication hole 55, and, at its initial position, engages the front end surface of the second piston member 25 at its initial position at its one end and extends into the fluid containing chamber 23 at its other end as illustrated in FIG. 8. Thus, when the first piston member 21 reaches a stroke end adjacent to the end cover 47, the stopper 57 is pushed by the first piston member 21 into a clockwise rotation as seen in FIGS. 8 and 9, and is moved away from the second piston member 25 as illustrated in FIG. 9.

In this embodiment, a light reflecting sheet 41 such as aluminum foil is attached to the rear end surface of the second piston member 25, and a magnetic sheet 42 is attached to the front end surface of the second piston member 25.

Figure 9:
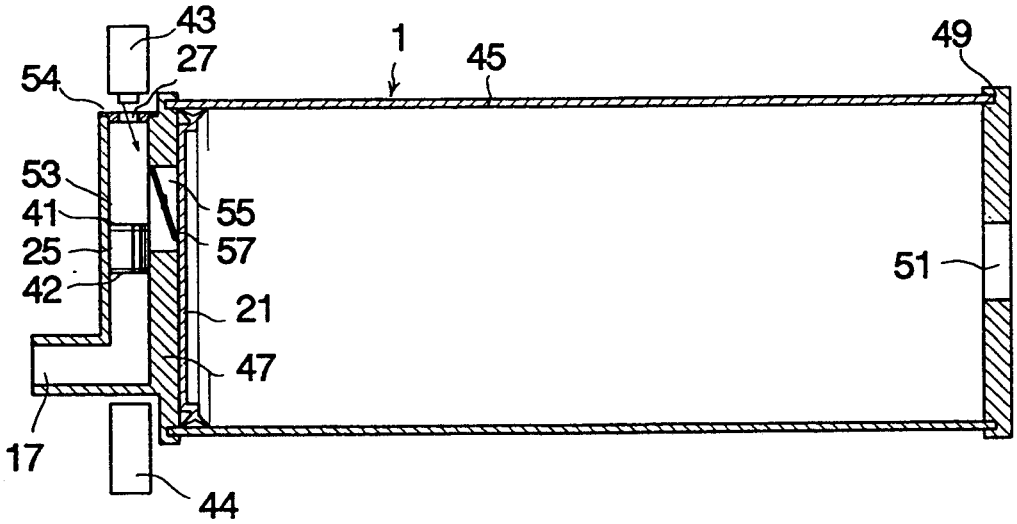
FIG. 9 is a sectional view of the sixth embodiment of the fluid container according to the present invention showing the manner of movement of the second piston member.
Figure 10:
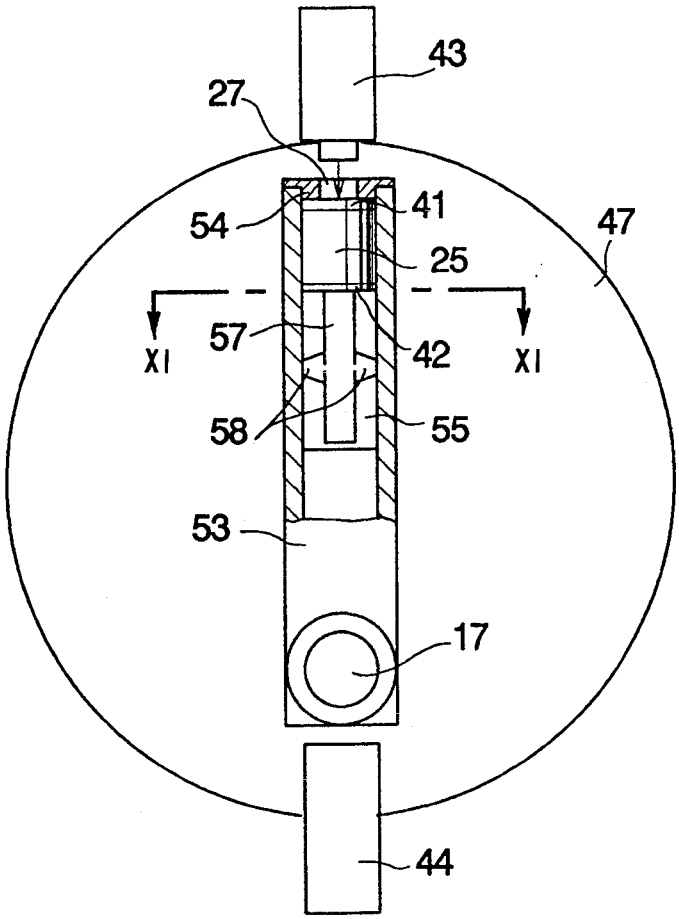
FIG. 10 is an enlarged sectional view of an essential part of the sixth embodiment of the fluid container according to the present invention.
Figure 11:
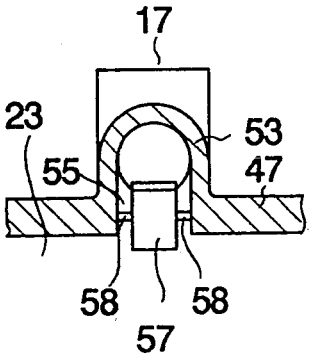
FIG. 11 is a sectional view taken along line XI—XI of FIG. 10.

A photoelectric switch 43 is placed at an upper end of the end cover 47 of the container main body 1 as seen in FIGS. 8 and 9. The photoelectric switch 43 is positioned such that the light therefrom is directed to the air vent hole 27 of the end cap 54, and the light reflected by the light reflecting sheet 41 may be received by the photoelectric switch 43.

A reed switch 44 is placed at a lower end of the end cover 47 of the container main body 1 as seen in FIGS. 8 and 9. The reed switch 44 changes its state when the second piston member 25 reaches the end adjacent to the content outlet 17, and is activated by the magnetic sheet 42 secured to the second piston member 25.

In this embodiment also, when the content outlet 17 is first connected to the suction hole of a suction pump not shown in the drawings, and a suction is applied to the content outlet 17, the content filled into the interior of the content expelling tube 53 and the interior of the fluid containing chamber 23 is sucked out of the content outlet 17 via the communication hole 55 and the interior of the content expelling tube 53. As the content is expelled from the interior of the content expelling tube 53 and the fluid containing chamber 23, the first piston member 21 is passively forced to move to the left as seen in the drawings in the axial direction inside the container main body 1.

Until the first piston member 21 reaches its stroke end on the left hand side of the drawings, and is brought into contact with the end cover 47, the stopper 57 maintains its initial condition as illustrated in FIG. 8, and the second piston member 25 is kept engaged at its initial position and remains stationary.

Thereby, the content of the fluid containing chamber 23 can be continued to be taken out by the axial movement of the first piston member 21 without being obstructed by the second piston member 25.

In this case also, while the content of the fluid containing chamber 23 is being taken out, and the second piston member 25 is thereby kept at its initial position, the light projected from the photoelectric switch 43 projected upon the air vent hole 27 of the end cap 54 reaches the light reflecting sheet 41 of the second piston member 25, and is reflected back to the photoelectric switch 43.

As a result, the photoelectric switch 43 receives the light projected upon the air vent hole 27 of the end cap 54 as light reflected by the light reflecting sheet 41 of the second piston member 25, and produces, for instance, an ON-signal. In this case also, this ON-signal may be employed to indicate that the fluid container is positioned at its proper position.

When the first piston member 21 reaches its stroke end on the left hand side of FIG. 9 and comes into contact with the end cover 47 as illustrated in this drawing, all the content in the fluid containing chamber 23 has been taken out. At this time point, the first piston member 21 pushes the stopper 57 into clockwise rotation as seen in FIGS. 8 and 9, and is moved away from the second piston member 25 as illustrated in FIG. 9.

As a result, the second piston member 25 is allowed to move from is initial position inside the content expelling tube 53 downward as seen in FIGS. 8 and 9, or towards the content outlet 17. This movement of the second piston member 25 causes the content inside the content expelling tube 53 to be taken out from the content outlet 17.

Once the second piston member 25 starts moving away from its initial condition, the light projected by the photoelectric switch 43 upon the air vent hole 27 of the end cap 54 fails to reach the light reflecting sheet 41 of the second piston member 25 because the second piston member 25 is no longer at its initial position. As a result, receiving no reflected light, the photoelectric switch 43 changes its state, and produces an OFF-signal.

Therefore, in this case also, once all the content inside the fluid containing chamber 23 has been taken out, the output signal from the photoelectric switch 43 undergoes a change, and it is notified to the operator that the content is remaining only in the content expelling tube 53, and the time at which all the content inside the fluid container is depleted and the fluid container has to be replaced is coming soon.

In this case also, since the inner cross sectional area of the content expelling tube 53 is substantially smaller than that of the fluid containing chamber 23, for a given rate of taking out the content from the content outlet 17, the speed of the movement of the second piston member 25 in taking out the content from the content outlet 17 is substantially greater than the corresponding speed of the first piston member 21. Thus, since the movement of the second piston member 25 is more pronounced than that of the first piston member 21, it is possible to promptly detect that the second piston member 25 has started moving away from its initial position and that the state of the photoelectric switch 43 is thereby reversed by the failure of the light from the photoelectric switch 43 to reach the light reflecting sheet 41 of the second piston member 25, without any delay from the moment the second piston member 25 has started moving. Thus, the detection of the depletion of the content all but inside the content expelling tube 53 can be accomplished reliably and promptly.

When all the content of the content expelling tube 53 has been taken out and the second piston member 25 has reached the end adjacent to the content outlet 17, the reed switch 44 is activated by the magnetic sheet 42 of the second piston member 25, and it indicates that all the content of the fluid container has been taken out.

In this detection process also, since the speed of the movement of the second-piston member 25 is substantially greater than the corresponding speed of the first piston member 21, and the movement of the second piston member 25 is substantially more pronounced than that of the first piston member 21, it is possible to detect that the second piston member 25 has actually reached the end adjacent to the content outlet 17 in a reliable and stable fashion.

Figure 12:
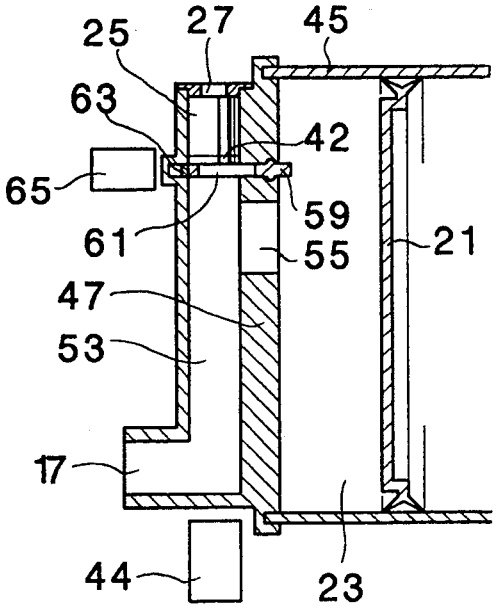
FIG. 12 is an enlarged sectional view of an essential part of a seventh embodiment of the fluid container according to the present invention.
Figure 13:
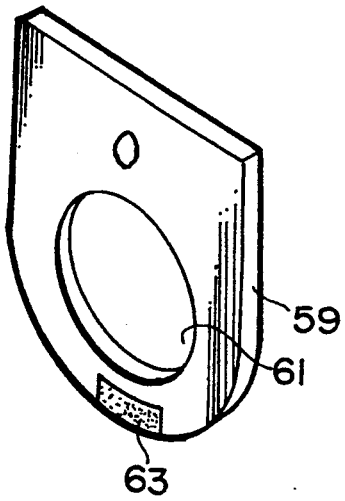
FIG. 13 is a perspective view of an example of the gate plate used in the seventh embodiment of the fluid container according to the present invention.

FIGS. 12 and 13 show a seventh embodiment of the fluid container according to the present invention. In FIGS. 12 and 13, the parts corresponding to those of FIGS. 8 through 11 are denoted with like numerals. In this embodiment, instead of the stopper 57, the end cover 47 is provided with a moveable gate plate 59 for engaging the second piston member 25 at its initial position.

The gate plate 59 can move across the content expelling tube 53, and is provided with an opening 61 which allows the second piston member 25 to pass therethrough. The gate plate 59 is retained at its initial position in which the opening 61 is positioned remote from the content expelling tube 53 and close to the fluid containing chamber 23 so as to retain the second piston member 25 at its initial position. When the first piston member 21 has reached its stroke end adjacent to the end cover 47, the gate plate 59 is pushed by the first piston member 21 into a leftward movement as seen in FIG. 12, and the opening 61 is thereby made to align with the content expelling tube 53 so as to be opened up and permit the passage of the second piston member 25 therethrough.

The free end of the gate plate 59 is provided with a magnetic member 63 serving as a sensing portion.

A magnetic-type proximity switch 65 is provided in a part of the end cover 47 of the container main body 1 on the left hand side of the drawing. The proximity switch 65 is activated by the magnetic member 63 of the gate plate 59 when the gate plate 59 is at its open position, and changes its output signal through a switch-over of its contacts.

In this case, the light reflecting sheet 41 of the second piston member 25 is omitted, and only a magnetic sheet 42 is provided on the front surface of the second piston member 25.

In this embodiment, while the content is being taken out from the fluid containing chamber 23, the gate plate 59 is at its closed position and retains the second piston member 25 at its initial position. When the first piston member 21 reaches its stroke end on the left hand side of the drawing, and comes into contact with the end cover 47, the first piston member 21 pushes the gate plate 59 so as to place the opening 61 at its open condition. As a result, when the suction is continued to be applied to the content outlet 17, the second piston member 25 starts moving from its initial position, and, after passing through the opening 61 of the gate plate 59, moves downward as seen in FIG. 12 or towards the content outlet 17. Thus, the movement of the second piston member 25 allows the content of the content expelling tube 53 to be taken out from the content outlet 17.

When the gate plate 59 has moved from its closed position to its open position as described above, the magnetic member 63 of the gate plate 59 comes close to the proximity switch 65, and the proximity switch 65 is thereby activated so as to switch over its contacts and change its output signal.

Therefore, in this case, when all the content of the fluid containing chamber 23 is all taken out, the output signal from the proximity switch 65 changes, and it indicates that all the content in the fluid containing chamber 23 has been taken out, and the fluid container is required to be changed soon.

When the content inside the content expelling tube 53 is also all taken out, and the second piston member 25 reaches its stroke end adjacent to the content outlet 17, the reed switch 44 is activated by the magnetic sheet 42 of the second piston member 25, and switches over its contacts so as to indicate that all the content in the fluid container has been taken out.

In this embodiment also, since the internal cross section of the fluid expelling tube 53 is substantially smaller than the cross section of the fluid containing chamber 23, the speed of the movement of the second piston member 25 is substantially greater than the corresponding speed of the first piston member 21, and the movement of the second piston member 25 is substantially more pronounced than that of the first piston member 21. Therefore, it is possible to detect with the reed switch 43 that the second piston member 25 has actually reached the end adjacent to the content outlet 17 in a reliable and stable fashion.

Figure 14:
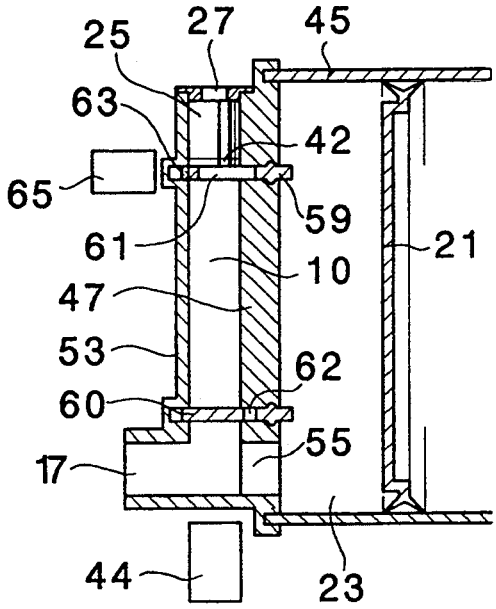
FIG. 14 is a sectional view showing an initial condition of an eighth embodiment of the fluid container according to the present invention.

FIG. 14 shows an eighth embodiment of the fluid container according to the present invention. In FIG. 14, the parts corresponding to those of FIG. 12 are denoted with like numerals. In this embodiment, the communication hole 55 is provided adjacent to the content outlet 17, and a part of the fluid expelling tube 53 denoted with numeral 10 is allocated as a second fluid containing chamber, and this second fluid containing chamber 10 is adapted to accommodate a content which is different from the content of the fluid containing chamber 23.

At the boundary between the first and second fluid containing chambers 23 and 10, for the purpose of preventing the mixing of the contents of the two fluid containing chambers 23 and 20, a separator plate 60 is provided. The separator plate 60 is provided with an opening 62 for taking out the content. In its initial condition, the separator plate 60 is retained at a position in which the opening 62 is remote from the content expelling tube 53 and close to the fluid containing chamber 23 so as to close the second fluid containing chamber 10. When the first piston member 21 reaches its stroke end adjacent to the end cover 47, the first piston member 21 is pushed leftward as seen in FIG. 14, and the opening 62 is placed in the fluid expelling tube 53 so as to open up the second fluid containing chamber 10.

Therefore, in this embodiment, when the content of the fluid containing chamber 23 is all taken out, the separator plate 60 moves from its closed position to its open position, and the content of the second fluid containing chamber 10 is thereby allowed to be taken out.

The fluid container of this embodiment is suitable for accommodating two mutually chemically reactive liquid parts.

In this embodiment also, since the internal cross section of the fluid expelling tube 53 is substantially smaller than the cross section of the fluid containing chamber 23, the speed of the movement of the second piston member 25 is substantially greater than the corresponding speed of the first piston member 21, and the movement of the second piston member 25 is substantially more pronounced than that of the first piston member 21. Therefore, it is possible to detect with the reed switch 44 that the second piston member 25 has actually reached the end adjacent to the content outlet 17 and, therefore, that the content of the fluid containing chamber has been all taken out in a reliable and stable fashion.

Figure 15:
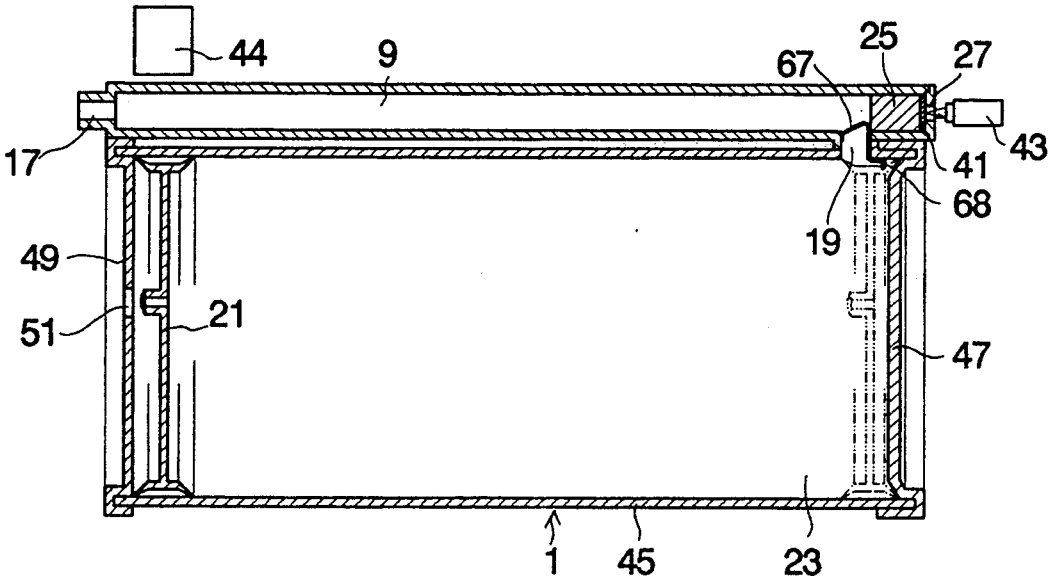
FIG. 15 s a sectional view showing an initial condition of a ninth embodiment of the fluid container according to the present invention.

FIG. 15 shows a ninth embodiment of the fluid containing chamber according to the present invention. In FIG. 15, the parts corresponding to those of previously described embodiments are denoted with like numerals. In this embodiment, a content expelling tube 9 having a smaller diameter than the container main body 1 is fixedly secured outside the container main body 1 so as to extend axially therein, and is provided with a stopper strip 67 adjacent to a communication hole 19.

The stopper strip 67 is made of a flexible sheet member, and has a base end which is fixedly secured, and a free end 68 which is shaped like a hook. In the initial condition of the stopper strip 67, it projects into the content expelling tube 9 and engages an end surface of the second piston member 25 at its initial condition. However, with the free end 68 being engaged by the first piston member 21, as the first piston member 21 reaches its stroke end adjacent to the end cover 47, the free end 68 is pulled into deformation, and, by being thus cleared out of the content expelling tube 9, the second piston member 25 is released from the engagement at its initial position.

In this embodiment, a light reflecting sheet 41 consisting of aluminum foil or the like is attached to the rear end surface of the second piston member 25, and the outer circumference of the second piston member 25 is surrounded by a magnetic member.

A photoelectric switch 43 is placed on the right end of the content expelling tube 9 as seen in FIG. 15, and a reed switch 44 is placed on a part of the content expelling tube 9 adjacent to the content outlet 17.

In this embodiment, while the content is being taken out from the fluid containing chamber 23, the second piston member 25 is retained at its initial position by the stopper strip 67. However, when the first piston member 21 reaches its stroke end on the right hand side of the drawing, and comes into contact with the end cover 47, or, in other words, when the content in the fluid containing chamber 23 has been all taken out, the stopper strip 67 is pulled by the first piston member 21 to thereby disengage the second piston member 25, and the second piston member 25 is allowed to move inside the content expelling tube 9 from its initial position to the content outlet 17. This movement of the second piston member 25 forces the content inside the content expelling tube 9 out of the content outlet 17.

Once the second piston member 25 has started moving away from its initial position, the light which the photoelectric switch 43 has projected upon the air vent hole 27 of the content expelling tube 9 fails to reach the light reflecting sheet 41 of the second piston member 25 because the second piston member 25 is no longer at its initial position, and the photoelectric switch 43 which no longer receives the reflected light changes its state, and produces, for instance, an OFF-signal.

Therefore, in this case also., when the content in the fluid containing chamber 23 has been all taken out, the output signal from the photoelectric switch 43 changes, and it indicates that all but the content inside the fluid expelling tube 9 has been taken out from the fluid container and that the fluid container has to be replaced soon.

Therefore, in this case also, since the inner cross sectional area of the content expelling tube 9 is substantially smaller than that of the fluid containing chamber 23, for a given rate of taking out the content from the content outlet 17, the speed of the movement of the second piston member 25 in taking out the content from the content outlet 17 is substantially greater than the corresponding speed of the first piston member 21. Thus, since the movement of the second piston member 25 is more pronounced than that of the first piston member 21, it is possible to promptly detect that the second piston member 25 has started moving away from its initial position and that the state of the photoelectric switch 43 is thereby reversed by the failure of the light from the photoelectric switch 43 to reach the light reflecting sheet 41 of the second piston member 25, without any delay from the moment the second piston member 25 has started moving. Thus, the detection of the depletion of the content all but the part remaining inside the content expelling tube 9 can be accomplished reliably and promptly.

When the content inside the fluid expelling tube 9 has also been all taken out, and the second piston member 25 has reached its stroke end adjacent to the content outlet 17, the reed switch 44 is activated by the magnetic member surrounding the second piston member 25, and switches over its contacts. It indicates that the content inside the fluid container has been all taken out.

In this detection process also, since the speed of the movement of the second piston member 25 is substantially greater than the corresponding speed of the first piston member 21, and the movement of the second piston member 25 is substantially more pronounced than that of the first piston member 21, it is possible to detect that the second piston member 25 has actually reached the end adjacent to the content outlet 17 in a reliable and stable fashion.

Figure 16:
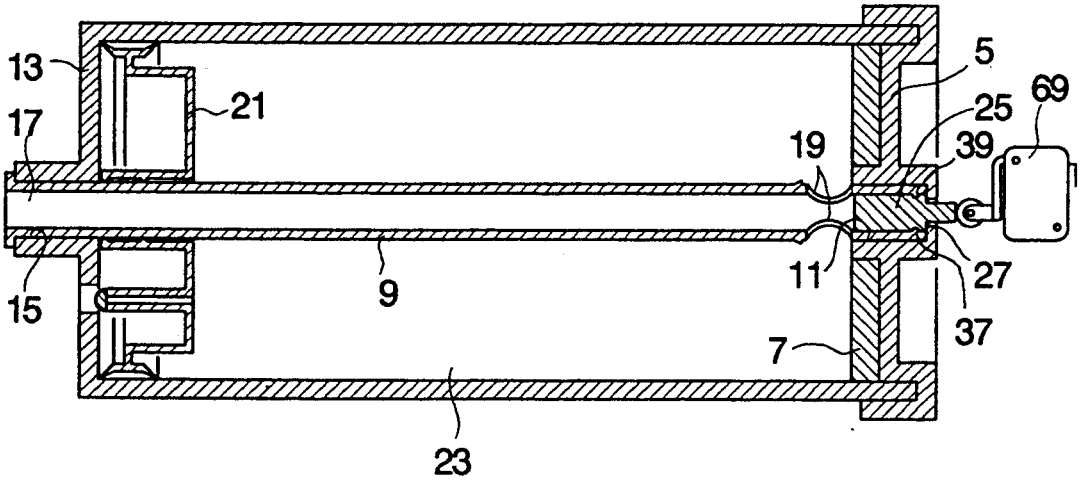
FIG. 16 is a sectional view showing an initial condition of a tenth embodiment of the fluid container according to the present invention.

Although the movements of the second piston member 25 and the gate plate 59 were detected by the photoelectric switch 43 and the proximity switch 65 in the above described embodiments, other non-contact switches can be also used, and it is also possible to use a contact switch such as a limit switch 69 shown in FIG. 16 (tenth embodiment).

The sensing portion provided in the second piston member 25 is not limited by the simple light reflecting sheet 41, but may also consist of bar codes and holograph which represent some information on the content accommodated in the fluid container. In such a case, the detecting means may consist of photoelectric reading devices such as bar code readers and light sensors.

The second piston member 25 may be incorporated with such components as a sensor, memory, an interface, a battery and so forth, and be adapted to store the number of the past replacements of the fluid container according to the number of the occurrence of the activation of the reed switch 44.

In any of the above described embodiments, because the driving force required for moving the second piston member 25 is substantially smaller than that required for moving the first piston member 21 due to the difference in the diameters of the corresponding pistons, there is a difference in the load in driving the corresponding pistons. Therefore, it is also possible to detect the movement of the second piston member 25 according to this load.

Figure 17:
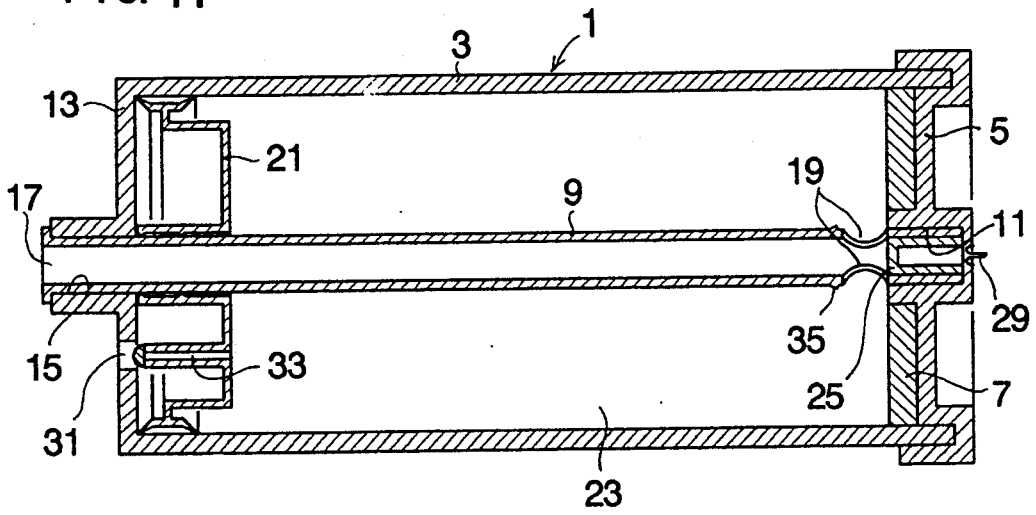
FIG. 17 is a sectional view of an eleventh embodiment of the fluid container according to the present invention at its initial state.
Figure 18:
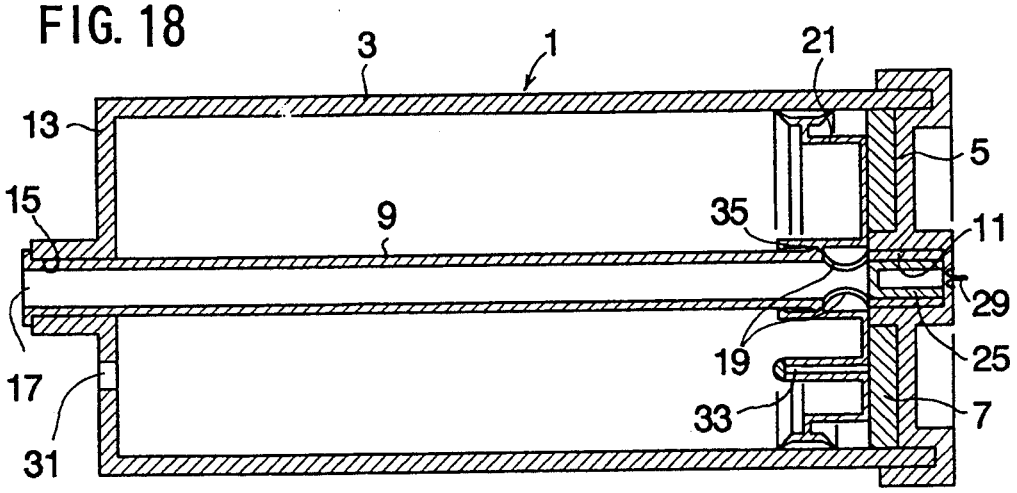
FIG. 18 s a sectional view of the eleventh embodiment of the fluid container according to the present invention when the first piston member has reached its stroke end.
Figure 19:
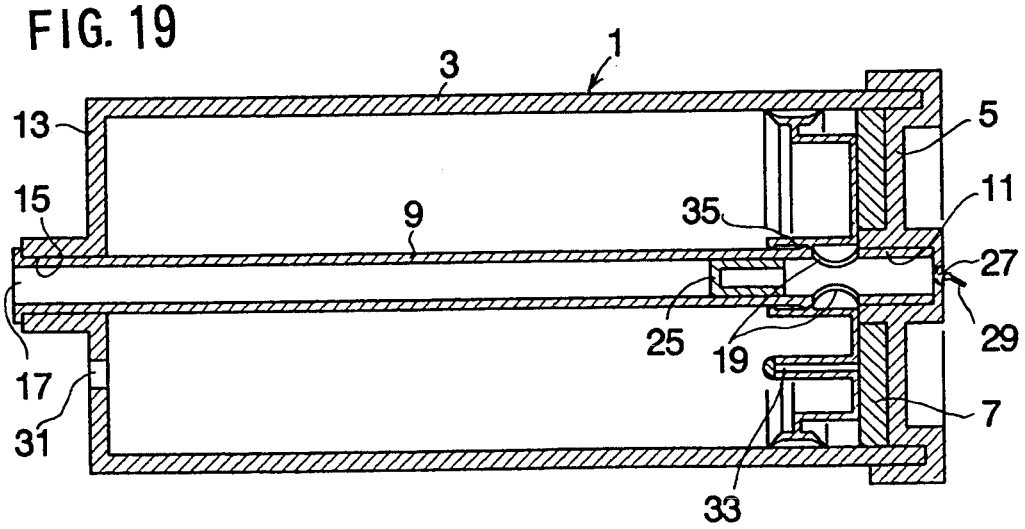
FIG. 19 is a sectional view of the eleventh embodiment of the fluid container according to the present invention showing the manner of movement of the second piston member.

FIGS. 17 through 19 show an eleventh embodiment of the fluid container according to the present invention. This embodiment is similar to the embodiment illustrated in FIGS. 1 and 2, and the parts illustrated in FIGS. 17 through 19 are denoted with like numerals.

According to this embodiment, instead of the interlocking engagement portions 37 and 39 for engaging the second piston member 25 until the content inside the fluid containing chamber 23 has been all taken out, a part of the end wall 5 adjacent to the bottom end of the recess 11 for receiving the corresponding end of the content expelling tube 9 is provided with a tab 29 which can be torn off by hand. This tab 29 is so constructed as to defined an air vent 27 communicating the recess 11 with the container exterior when it is torn off.

According to the fluid container having the above described structure, first of all, when filling the container with the content, the first piston member 21 is placed at its initial position adjacent the end wall portion 13 of the cylindrical member 3 as illustrated in FIG. 17 with its air vent hole 33 opened up, and the content is filled into the fluid containing chamber 23 and the content expelling tube 9 from the content outlet 17 via the interior of the content expelling tube 9 and the communication holes 19 with the aid of pressure. When this pressure filling process is completed, the air vent hole 33 is closed for instance by thermal crimping. This process can be carried out by using the back air vent hole 31 of the end wall portion 13 of the cylindrical member 3 as an access hole.

The content filled into the container can be taken out by connecting the content outlet 17 with a suction hole of a suction pump not shown in the drawings. When content outlet 17 is first connected to the suction hole of a suction pump, and a suction (negative pressure) is applied to the content outlet 17, the content filled into the interior of the content expelling tube 9 and the content containing chamber 23 is sucked out of the content outlet 17 via the communication holes 19 and the interior of the content expelling tube 9. Following the expulsion of the content from the interior of the content expelling tube 9 and the fluid containing chamber 23, the first piston member 21 is passively forced to move to the right as seen in the drawing in the axial direction inside the container main body 1.

However, as long as the air vent hole 27 is not opened up, since the back end of the second piston member 25 is placed in a closed space and has no access to any air vent hole, even when the suction from the content outlet 17 is applied to the second piston member 25 via the content inside the content expelling tube 9, the second piston member 25 remains in the initial position as illustrated in FIG. 17.

When the first piston member 21 reaches its stroke end on the right hand side as seen in the drawings and is brought into contact with the spacer 7 as illustrated in FIG. 18, the content in the fluid container 23 is all taken out. However, in this condition, the content expelling tube 9 still contains some of the content.

The content remaining in the content expelling tube 9 can be taken out by tearing off the tab 29 and providing an air vent hole 27 behind the second piston member 25 as illustrated in FIG. 19.

When the suction from the content outlet 17 is applied to the second piston member 25 via the content existing inside the content expelling tube 9 in this condition, the second piston member 25 is moved from its initial position leftward or toward the content outlet 17 inside the content expelling tube 9, and this movement allows the content remaining in the content expelling tube 9 to be taken out from the content outlet 17.

By such a mechanism, when the first piston member 21 has reached its stroke end and come into contact with the spacer 7, and the content in the fluid containing chamber 23 has been depleted, the operator is notified that the fluid container will be required to be replaced soon. The operator then tears off the tab 29 by external operation, and the content remaining in the content expelling tube 9 can be continued to be taken out. Thus, the fluid container as a whole is provided with means for preventing the occurrence of a situation in which the content is suddenly depleted without any warning.

Figure 20:
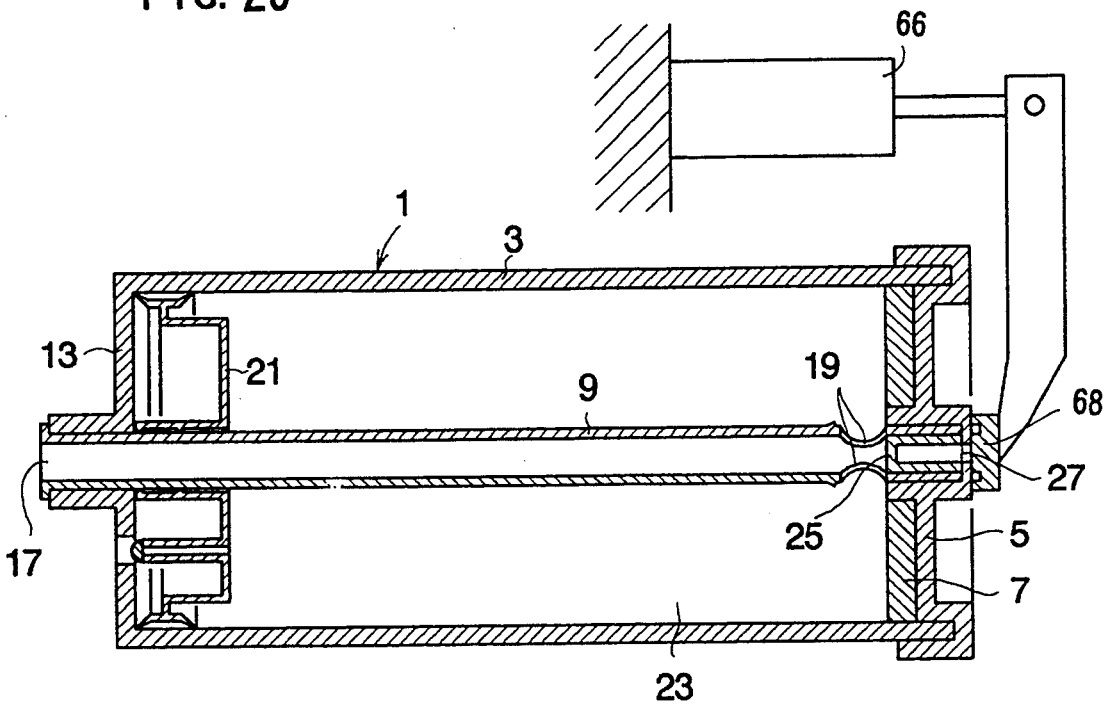
FIG. 20 is a sectional view showing an initial condition of a twelfth embodiment of the fluid container according to the present invention.

The opening of the air vent hole 27 or the disengagement of the second piston member 25 can be carried out not only by the tab 29 which can be torn off by hand, but also by a lid member 68 which is provided in a region for receiving the fluid container and actuated between a position to close the air vent hole 27 and a position to open the air vent hole 27 as illustrated in FIG. 20 (twelfth embodiment).

Figure 21:
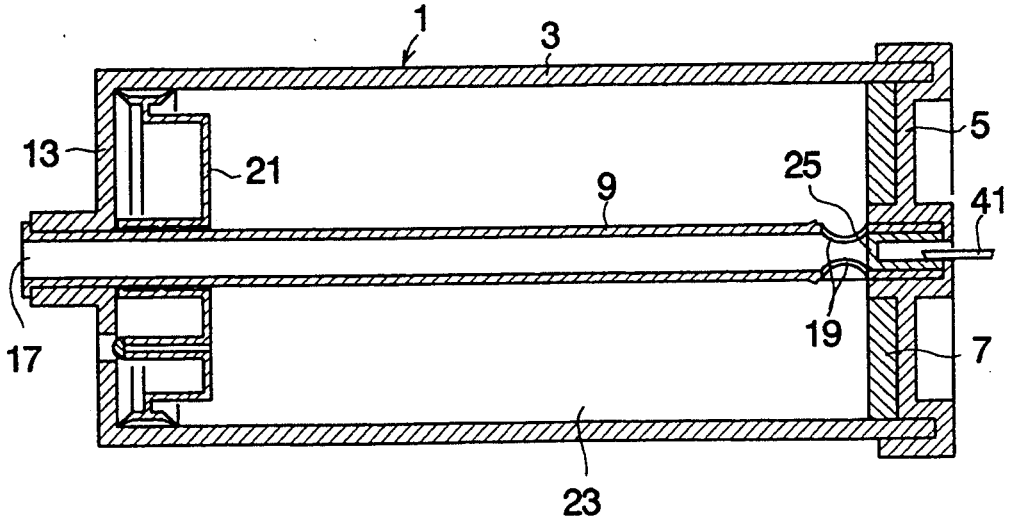
FIG. 21 is a sectional view showing an initial condition of a thirteenth embodiment of the fluid container according to the present invention.

Further, the engagement of the second piston member 25 can be effected mechanically by using such means as an engagement pawl member 41 which removable bites into the second piston member 25 as illustrated in FIG. 21 (thirteenth embodiment).

Figure 22:
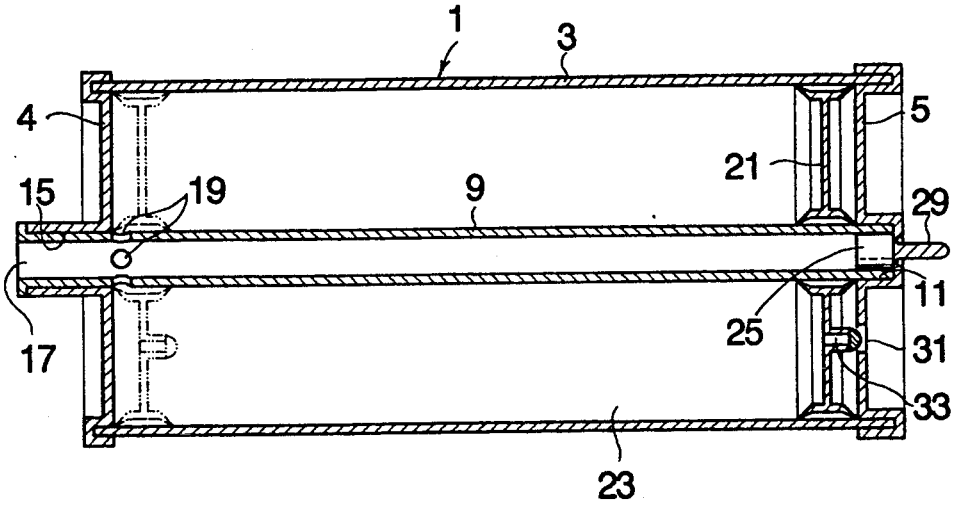
FIG. 22 is a sectional view showing an initial condition of a fourteenth embodiment of the fluid container according to the present invention.

FIG. 22 shows fourteenth embodiment of the fluid container according to the present invention. In FIG. 22, the parts corresponding to those of FIGS. 17 through 19 are denoted with like numerals. In this embodiment, the container main body 1 consists of a hollow cylindrical member 3 having two open ends, and a pair of end covers 4 and 5 which close the two open ends of the cylindrical member 3, and one of the end covers 4 on the left hand side as seen the drawing is provided with communication holes 19 which communicate the interior of the container main body 1 with the interior of the content expelling tube 9.

In this case, as indicated by the solid lines in FIG. 22, the initial position of the first piston member 21 is defined as a stroke end position at which the first piston member 21 abuts the end cover 5 on the right hand side as seen in the drawing, and the end wall closing the other end of the container main body 1 is formed by the other end cover 4.

In this embodiment also, the initial position of the second piston member 25 is defined at the right end of the content expelling tube 9 as seen in the drawing, and a tab 29 is provided on the end wall of the content expelling tube 9 on the right hand side of the drawing in the region which is defined by the end cover 5 as engagement means for forming an air vent hole 27 (refer to FIG. 19) by being torn off by hand.

When the content outlet 17 is first connected to the suction hole of a suction pump, and a suction is applied to the content outlet 17, the content filled into the interior of the fluid containing chamber 23 is sucked out of the content outlet 17 via the communication holes 19 and the interior of the content expelling tube 9. As the content is expelled from the interior of the fluid containing chamber 23, the first piston member 21 is passively forced to move to the left as seen in the drawing in the axial direction inside the container main body 1. In this case also, as long as the air vent hole 27 is not opened up, the second piston member 25 is kept engaged at its initial position, and remains stationary at its initial position.

When the first piston member 21 has reached its stroke end on the left hand side of the drawing, and come into contact with the end cover 4, the content of the fluid containing chamber 23 is completely depleted. When the tab 29 is torn off by hand and the air vent hole 27 is opened up in this condition, in this embodiment also, the second piston member 25 is allowed to move from its initial position to the left hand side as seen in the drawing or towards the content outlet 17 inside the content expelling tube 9. This movement of the second piston member 25 allows the content remaining in the content expelling tube 9 to be expelled from the content outlet 17.

Figure 23:
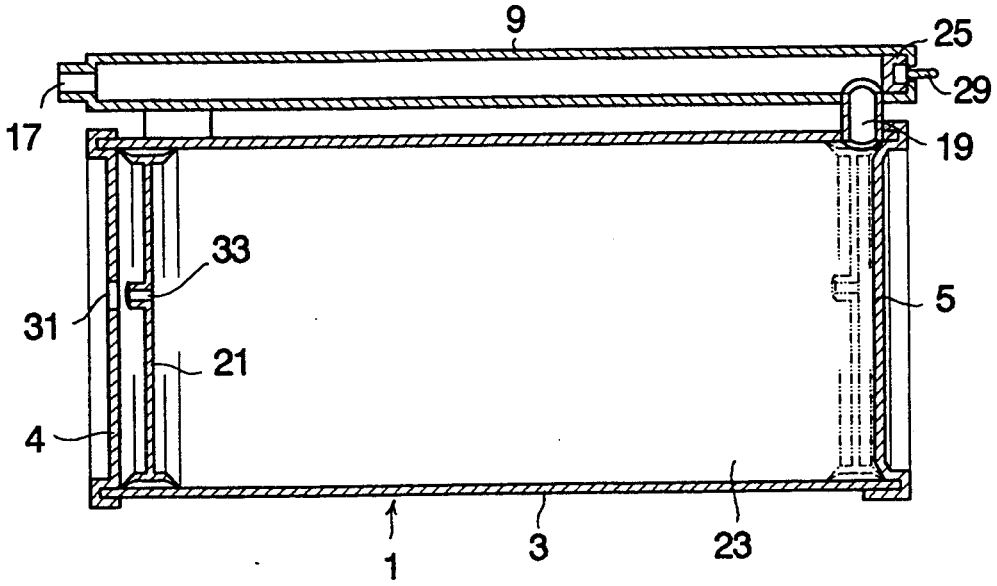
FIG. 23 is a sectional view showing an initial condition of a fifteenth embodiment of the fluid container according to the present invention.

In regard to the embodiments in which the second piston member 25 is allowed to be moved by the suction applied to the content outlet 17, the content expelling tube 9 is not necessarily required to be provided inside the container main body 1, and serve as a guide for the axial movement of the first piston member, but may be provided outside of the container main body 1 as illustrated in FIG. 23 (fifteenth embodiment).

Although the present invention has been described in terms of specific embodiments thereof, it is possible to modify and alter details thereof without departing from the spirit of the present invention.

What I claim is:

1. A fluid container, comprising:

a container main body consisting of a hollow shell member;

a first piston member internally received in said container main body in an axially slidable manner so as to define a fluid containing chamber of a variable internal volume in cooperation with associated walls of said container main body;

a content expelling tube fixedly secured to said container main body, and defining a content outlet at one end thereof;

communication means for communicating said fluid containing chamber with said content outlet via at least a part of the interior of said content expelling tube;

a second piston member internally received in an initial position defined in a part of said content expelling tube remote from said content outlet in an axially slidable manner; and engagement means for selectively securing said second piston member at said initial position until said first piston member has reached a stroke end corresponding to a minimum internal volume of said fluid containing chamber whereupon said engagement means releases said second piston allowing said second piston to move inside said content expelling tube toward said content outlet;

rear ends of said first and second piston members having access to respective air vent holes.

2. A fluid container according to claim 1, wherein said content expelling tube extends centrally and axially inside said container main body, and said first piston member is externally fitted on said content expelling tube whereby said content expelling tube serves as guide means for said axial movement of said first piston member.

3. A fluid container according to claim 2, wherein a free end of said content expelling tube defining said content outlet projects out from an end wall of said container main body while a base end of said content expelling tube is supported by an opposite wall of said container main body, said communication means comprising a communication opening provided in said base end of said content expelling tube.

4. A fluid container according to claim 3, wherein said engagement means consists of interlocking mechanical engagement means which can disengage said second piston member by a suction applied to said content outlet for taking out a content of said fluid containing chamber when the content inside said fluid containing chamber has been substantially all taken out and said first piston member has reached said stroke end.

5. A fluid container according to claim 3, wherein said engagement means comprises an engagement piece which extends from said second piston member, and is passed through said communication opening in such a manner that said second piston member is normally engaged at said initial position by engagement between said engagement piece and said communication opening but is disengaged when said first piston member reaches said stroke end and disengages said engagement piece from said communication opening.

6. A fluid container according to claim 3, wherein said container main body is provided with stopper means for defining said stroke end of said first piston member, and an end wall consisting of bellows means which defines said minimum internal volume of said fluid containing chamber in cooperation with said first piston member after said first piston member is engaged by said stopper means, and said engagement means is adapted to disengage said second piston member by pressure applied by a part of said end wall as said end wall undergoes a contracting movement due to a suction applied to said content outlet after said first piston member has reached said stroke end and has been engaged by said stopper means.

7. A fluid container according to claim 3, wherein said container main body is provided with stopper means for defining said stroke end of said first piston member, and an end wall consisting of bellows means which defines said minimum internal volume of said fluid containing chamber in cooperation with said first piston member after said first piston member is engaged by said stopper means, and said engagement means is adapted to disengage said second piston member by closing said communication opening by a part of said end wall as said end wall undergoes a contracting movement due to a suction applied to said content outlet after said first piston member has reached said stroke end and has been engaged by said stopper means.

8. A fluid container according to claim 2, wherein a free end of said content expelling tube defining said content outlet projects out from an end wall of said container main body while a base end of said content expelling tube is supported by an opposite wall of said container main body, said communication means consisting of at least one opening provided in a part of said content expelling tube located inside said container main body and adjacent to said free end of said content expelling tube.

9. A fluid container according to claim 8, wherein said engagement means consists of interlocking mechanical engagement means which can disengage said second piston member by a suction applied to said content outlet for taking out a content of said fluid containing chamber when the content inside said fluid containing chamber has been substantially all taken out and said first piston member has reached said stroke end.

10. A fluid container according to claim 1, wherein said content expelling tube extends along an end wall of said container main body adjacent to said stroke end of said first piston member corresponding to said minimum internal volume of said fluid containing chamber.

11. A fluid container according to claim 10, wherein said communication means comprises a communication opening provided in a base end of said content expelling tube remote from said content outlet, said communication opening normally communicating said fluid containing chamber with an interior of said content expelling tube.

12. A fluid container according to claim 11, wherein said engagement means comprises an engagement piece which normally engages said second piston member at said initial position, but disengages said second piston member when said first piston member has reached said stroke end and pushed said engagement piece away from said second piston member.

13. A fluid container according to claim 12, wherein said engagement piece comprises a hinge plate member moveably attached to a member defining said communication opening by hinge means having a hinge axis extending diametrically across said communication opening.

14. A fluid container according to claim 12, wherein said engagement piece comprises a gate plate member slidably supported by a member defining said communication opening so as to move into and out of said content expelling tube.

15. A fluid container according to claim 10, wherein said communication means comprises a communication opening provided in a part of said content expelling tube adjacent to said content outlet, and a separator plate normally separating at least a major part of the interior of said content expelling tube from said communication opening, said communication opening normally communicating said fluid containing chamber with an interior of said content expelling tube, and said separator plate being moved so as to establish a communication between said major part of the interior of said content expelling tube and said communication opening when said first piston member has reached said stroke end and pushed said separator plate.

16. A fluid container according to claim 10, wherein said content expelling tube is at least semi-transparent so that the content may be visible from outside.

17. A fluid container according to claim 1, wherein said content expelling tube extends along a side wall of said container main body substantially in parallel with a direction of movement of said first piston member.

18. A fluid container according to claim 17, wherein said content expelling tube is at least semi-transparent so that the content may be visible from outside.

19. A fluid container according to claim 1, further comprising tab means for normally closing said air vent hole for said second piston member, said tab means being adapted to be torn off so as to open up said air vent hole for said second piston member.

20. A fluid container according to claim 1, further comprising lid means for normally closing said air vent hole for said second piston member, said lid means being adapted to be selectively removed so as to open up said air vent hole for said second piston member.

21. A fluid container according to claim 1, further comprising means for detecting movement of said second piston member, an outer diameter of said second piston member being substantially smaller than that of said first piston member.

22. A fluid container according to claim 21, wherein said detecting means comprises a photoelectric sensor provided with a light emitting element and a light sensing element, and a reflective member secured to a rear end of said second piston member for interaction with said photoelectric sensor for said second piston member.

23. A fluid container according to claim 21, wherein said detecting means comprises a magnetic sensor disposed adjacent to said second piston member at said initial position, and a magnetic piece secured to said second piston member, whereby said magnetic sensor can detect movement of said second piston member from said initial position.

24. A fluid container according to claim 21, wherein said detecting means comprises a magnetic sensor disposed adjacent to said content outlet, and a magnetic piece secured to said second piston member, whereby said magnetic sensor can detect movement of said second piston member approaching a stroke end of said second piston member.

* * * * *